United States Patent [19]

Moran et al.

[11] Patent Number: 4,912,369

[45] Date of Patent: Mar. 27, 1990

[54] HIGH PRF HIGH CURRENT SWITCH

[75] Inventors: Stuart L. Moran, Fredericksburg, Va.; R. Kenneth Hutcherson, College Park, Md.

[73] Assignee: United States of America as represented by the Secretary of the Navy, Washington, D.C.

[21] Appl. No.: 247,801

[22] Filed: Sep. 16, 1988

[51] Int. Cl.[4] ..... H01J 7/44; H01J 17/20; H01J 17/34

[52] U.S. Cl. ..... 315/58; 313/570; 313/637

[58] Field of Search ..... 315/58, 71, 111.01, 315/111.21, 111.31, 330; 313/567, 568, 570, 601, 602, 637

[56] References Cited

U.S. PATENT DOCUMENTS

| | | | |
|---|---|---|---|
| 3,531,683 | 9/1970 | Huckabay | 315/36 |
| 3,983,438 | 9/1976 | Levatter et al. | 313/146 |
| 4,027,187 | 5/1977 | Rabe | 313/217 |
| 4,126,808 | 11/1978 | Rich | 313/198 |
| 4,277,719 | 7/1981 | Riggins | 313/325 |
| 4,604,554 | 8/1986 | Wooton | 315/330 |
| 4,727,298 | 2/1988 | Mendel | 315/340 |
| 4,771,168 | 9/1988 | Gundersen et al. | 313/538 X |

*Primary Examiner*—David Mis

*Attorney, Agent, or Firm*—John D. Lewis; Kenneth E. Walden

[57] ABSTRACT

A triggerable, high voltage, high current, spark gap switch for use in pulse power systems. The device comprises a pair of electrodes in a high pressure hydrogen environment that is triggered by introducing an arc between one electrode and a trigger pin. Unusually high repetition rates may be obtained by undervolting the switch, i.e., operating the trigger at voltages much below the self-breakdown voltage of the device.

20 Claims, 2 Drawing Sheets

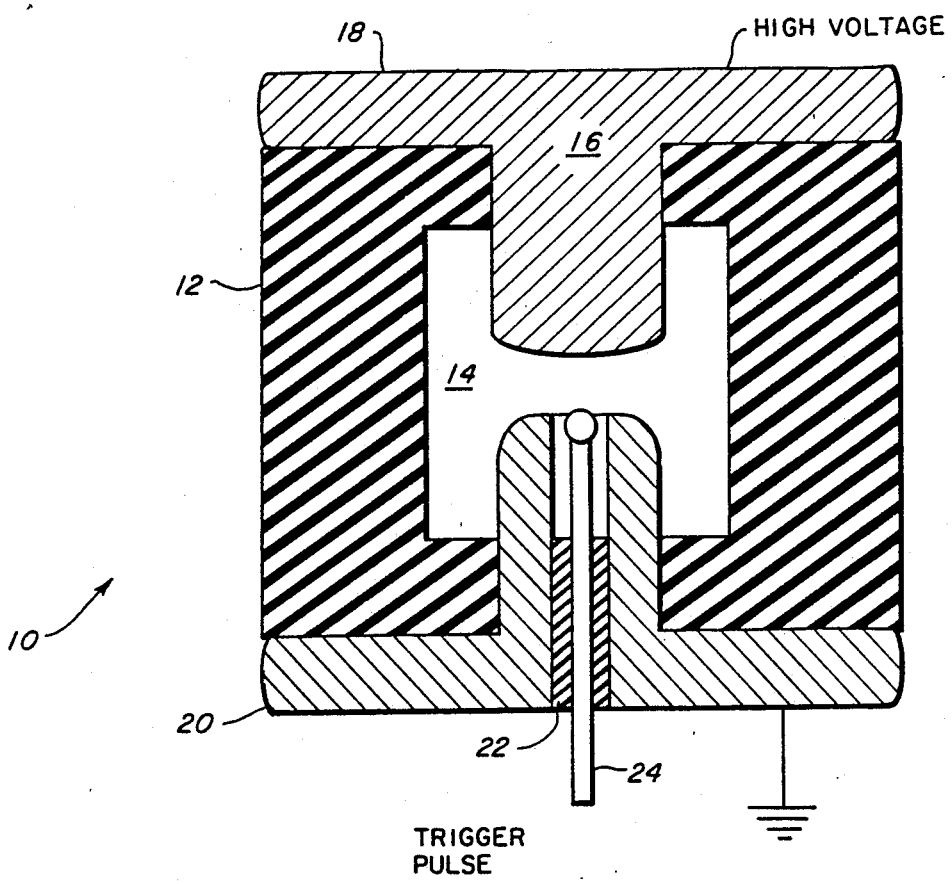
FIG. 1
FIG. 3
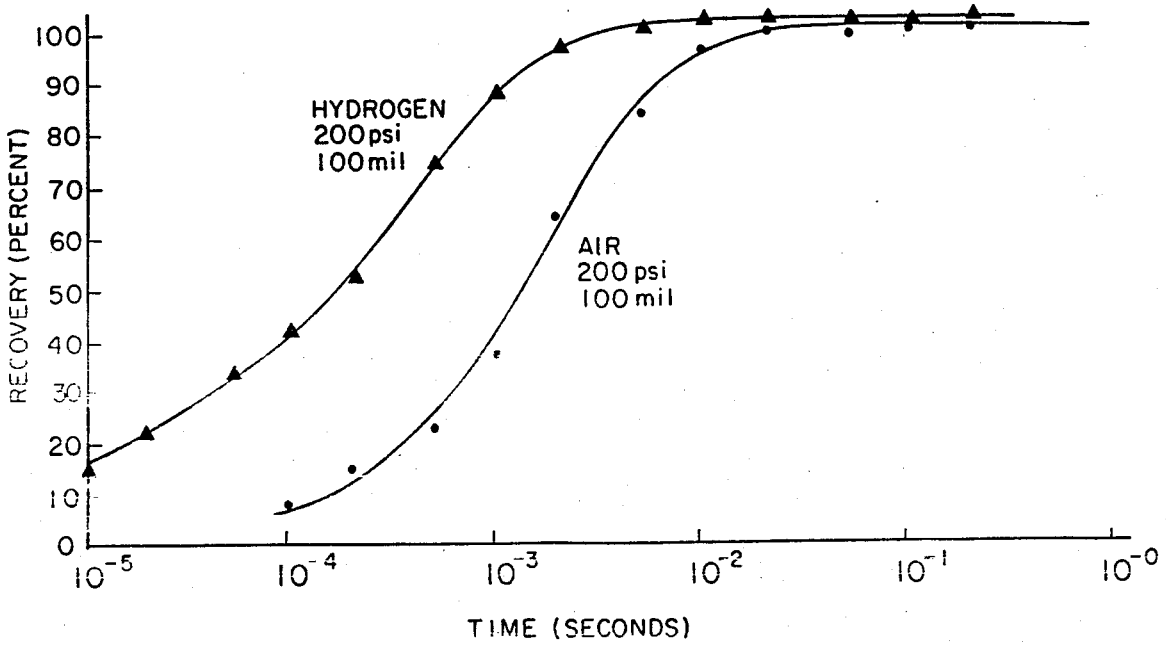

HIGH PRF HIGH CURRENT SWITCH

The U.S. Government has rights in this invention and the invention described herein may be manufactured and used by or for the Government of the United States for all governmental purposes without the payment of any royalty.

The field of this invention is pulse power technology and relates generally to high current components. The disclosed device, in particular, is a triggerable, spark gap switch capable of maintaining a high pulse repetition rate.

BACKGROUND OF THE INVENTION

Many devices require high peak power pulses for their operation. This field of pulse power technology includes particle beam accelerators, high power microwave devices, high energy lasers, nuclear effects simulators and fusion devices. The field is replete with switching devices capable of high power, and the most common of these is known as the spark gap switch.

A simple spark gap switch consists of two electrodes separated by an insulating gas. One electrode usually has a hole inside of which is a trigger pin. This trigger pin is used to initiate the main spark discharge using a low-energy pulse. It has been demonstrated that these devices can handle millions of volts and hundreds of kiloamps in low repetition rate applications (less than one hertz). Problems arise when attempts are made to operate these spark gaps at high repetition rates. When a spark forms, it heats the gas surrounding the spark causing it to "close" and conduct electricity. The switch will not "open" until the current stops and the gas cools down again. Repetition rate is limited by how long it takes to get rid of the heat in the gas. This is called the recovery time. Although low-energy spark gaps have been operated at high repetition rates, high-power switches are typically limited to about 10 Hz. One approach to faster operation has been to use blowers to move hot gases out of the switch region and replace it with cool gases. For repetition rates above 1,000 Hz, cooling requires supersonic gas flow. The blowers cause the switch system to be very large and inefficient. One supersonic switch of this type is disclosed in Rabe, U.S. Pat. No.4,027,187, issued May 31, 1977.

Many of the existing spark gap switches are used as high voltage limiters or surge suppressors that fire when a predetermined voltage threshold is exceeded. These protection devices may be employed to protect series capacitors from overvoltage due to faults or lightning surges on transmission lines. One example of this type "single shot" spark gap switch is Riggins, U.S. Pat. No. 4,277,719, issued on July 7, 1981, which teaches a physical parts layout and construction technique for manufacturing a spark gap switch with increased current carrying capacity. The disclosed construction benefits occurred by reducing the tendency of the spark to blow out and transfer to elements other than the carbon electrodes. Mendel, U.S. Pat. No. 4,727,298, is a recent reference teaching an extremely high voltage and current switch employing a magnetic field to open the electrical path after the switch has fired. Mendel is triggered but is a "one shot" switch, i.e., repetition rates below 10 hz. Another U.S. patent issued on Nov. 21, 1978 to Rich bearing U.S. Pat. No. 4,126,808 discloses another triggered spark gap switch that operates in a vacuum and is triggered by a plasma injection.

Other prior art spark gap switches exhibit special triggering to improve timing, see; Wootton, U.S. Pat. No. 4,604,554 of Aug. 5, 1986, or use saturated vapor or liquid between the electrodes in an effort to reduce jitter and inductance, as does Levatter et al., U.S. Pat. No. 3,983,438 issued Sept. 28, 1976.

The above mentioned devices are all either "one shot" switches or have very low repetition rates. Efforts to increase the repetition rates of spark gap switches include Rabe, supra, which employs high speed gas flow to clear the triggering plasma from the switch path. Rabe requires very large blowers, compressors and air flow channels which reduces efficiency and makes it impractical to use gases other than air. It is believed that these physical restrictions would confine a Rabe device to systems restricting application to repetition rates below 1000 hz.

Another technique that uses magnetic fields to decrease wear and to improve repetition rate is taught in Huckabay, U.S. Pat. No. No. 3,531,683 issued Aug. 27, 1968. While improved PRF capability is an object of this disclosure, this technique is limited to medium range repetition rates somewhat below 2000 hz. as the arc must physically move to another region on the electrodes as the switch operates.

The above references, alone or in combination, fail to provide a triggerable spark gap switch that operates in the high voltage, 50 kilovolts and above, and high current, 30 kiloamps and beyond, while having the capability to switch gigawatt pulses at repetition rates of 10 kilohertz and above. This invention discloses a switch meeting or exceeding these parameters by a novel combination of undervolting the switch in a high pressure hydrogen gas environment.

SUMMARY OF THE INVENTION

It is an object of the instant invention to teach a high power switching device that can operate with a pulse repetition rate at or above 10,000 hertz.

It is another object of the present invention to provide a high PRF spark gap switch that can operate at 50 kilovolts and above.

It is yet another object of this invention to teach a spark gap switch capable of switching high power pulses greater than a gigawatt.

Another object of this invention disclosure is to teach a high repetition spark gap switch smaller in physical size than now is possible in pulse power technology.

A further object of the present invention is to disclose a high PRF spark gap switch that does not require large blowers, compressors or air flow channels.

Yet another object of the instant invention is to provide a high repetition rate pulse power switch that is triggerable.

Still another object of the present invention is to provide a high current spark gap switch that exhibits low operating resistance.

It is another object of the present invention to teach a very high power, high repetition rate spark gap switch that exhibits low resistance and can be incorporated in low impedance pulse power systems.

It is still a further object of this invention to disclose a triggerable spark gap switch employing high pressure hydrogen to lower operating temperatures.

It is still another object of the instant invention to disclose a spark gap switch that operates in an essentially pure hydrogen environment engendering a greatly enhanced recovery time.

It is yet another object of this invention to provide a high power spark gap switch that uses a relatively low energy trigger.

Additional objects, advantages and novel features of the invention will become apparent to those skilled in the art upon examination of the following description, or may be learned by practice of the invention. The objects and advantages of the invention may be realized and attained by means of the instrumentalities and combinations particularly pointed out in the appended claims.

To achieve the forgoing and other objects, and in accordance with the purpose of the present invention, as embodied and broadly described herein, the present invention combines the advantages of high pressure hydrogen gas and a substantially undervolted switch to greatly increase the repetition rates when operating above 50 kilovolts in a system exceeding 30 kiloamps and producing peak power pulses exceeding a gigawatt. These parameters are simultaneously exceeded in a switch significantly smaller in physical size than heretofore known within the pulse power art.

The present invention provides these and other advantages with three novel techniques.

The first is to operate at very high pressures, up to 1,000 pounds/square inch (psi). This allows the spacing between electrodes to be very small which provides a close proximity of cool surfaces to the hot spark channel. It also reduces the spark length which reduces the resistance of the spark and the amount of heat deposited in the gas. It also reduces the inductance of the switch, allowing it to be used in lower impedance systems. The high pressure also increases the gas density and therefore the heat capacity per unit volume, allowing a smaller region around the spark to be heated. Higher pressure also speeds up the onset of turbulent mixing.

The second is to operate the switch in hydrogen gas. This allows the heat to exit the spark channel faster due to the higher molecular speed and higher thermal conductivity. We have demonstrated that operating the spark gap switch in pure hydrogen provides approximately 10 times faster recovery when compared to air or other commonly used gases. Hydrogen is a light gas which also allows the spark channel to expand faster and thus reduces the amount of heat deposited in the switch.

The third advantage results from the unique triggering of the switch. If the voltage across the electrodes of the spark gas exceeds a certain value, called the self-breakdown value, the insulating gas will break down and the switch will "turn on". To control the timing of this breakdown, a typical spark switch has a large fraction of the self-breakdown voltage across the switch (usually about 90%) and the trigger pin is used to start the breakdown. The trigger pin is much more controllable than the main spark gap because it requires very low energy. The trigger pin is controlled by a high voltage but low current pulse which sparks between the pin tip and the adjacent electrode. This low-energy spark initiates the main discharge between the electrodes. The amount of time it takes to recover half of the self-breakdown voltage is approximately 10 times less than the time it takes to recover the full self-breakdown voltage. Therefore, if the switch can be operated at half of self-brakdown voltage, the repetition rate can be up to 10 times faster. This requires that the trigger pin be able to initiate the main spark with only half the self-breakdown voltage applied. We have demonstrated that the trigger pin can initiate the spark as low as one third of the self-breakdown voltage. For example, if the switch is desired to operate at 100 kilovolts, then the switch spacing and pressure must be adjusted so that the self-breakdown voltage is 300 kilovolts and the trigger must be able to initiate breakdown when only 100 kilovolts is placed across the switch. This is called undervolting the spark switch, and, in effect, allows the switch to operate at higher temperatures. It reduces the requirement that the gas return to its original cold state since the gas does not have to completely cool to prevent the spark from reforming. This allows faster recovery because the heat can escape faster due to the higher thermal gradients.

These and other objects, features and advantages of the invention will be evident from the following detailed description when read in conjunction with the accompanying drawings which illustrate various embodiments of the invention.

BRIEF DESCRIPTION OF THE DRAWINGS

FIG. 1 is a front sectional view of a simplified embodiment of the High Repetition rate switch.

FIG. 3 is a graph of oscilloscope data showing the improved recovery time resulting from the use of hydrogen gas.

DETAILED DESCRIPTION OF THE INVENTION

Figure 2:
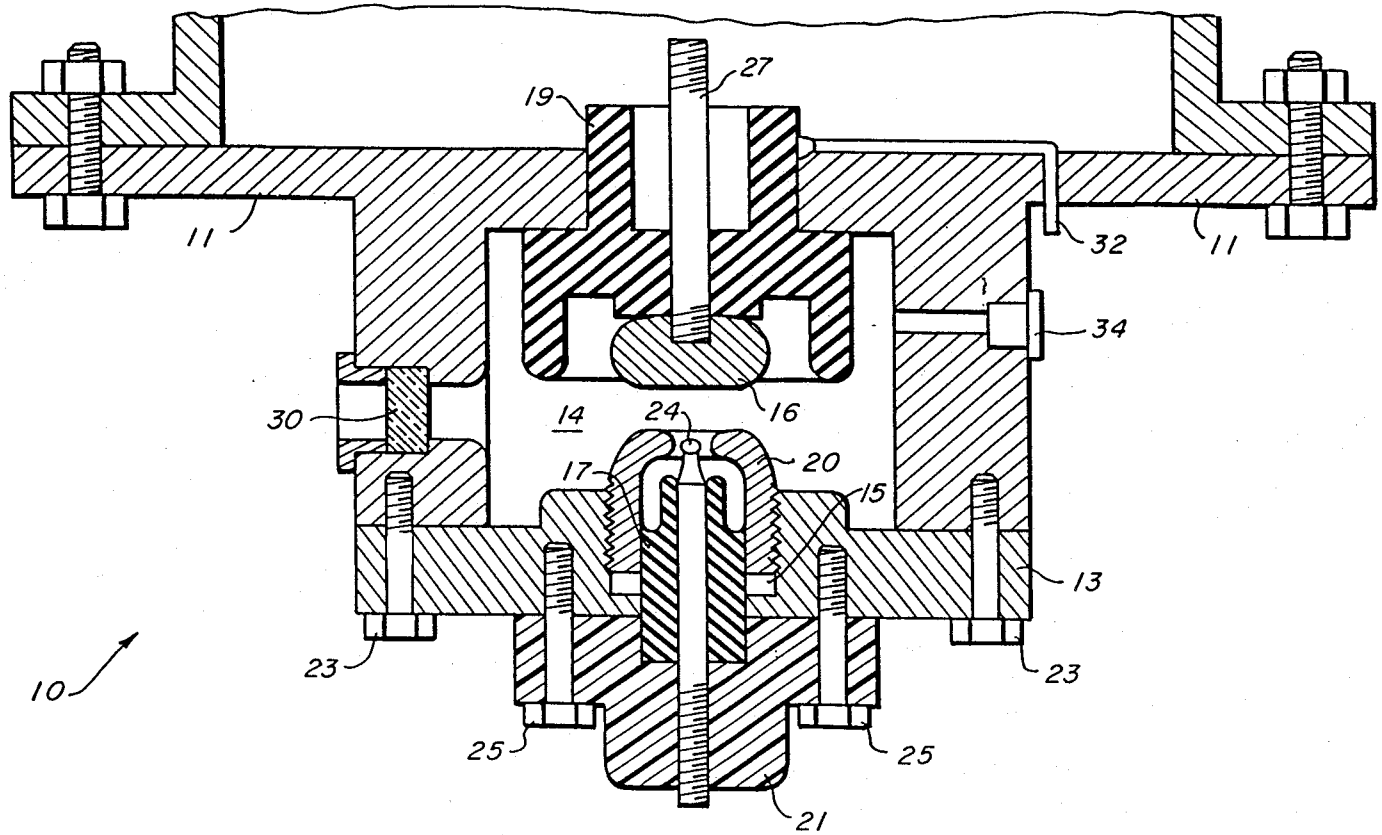
FIG. 2 is a front sectional view of the test switch employed in measuring the parameters of the invention.

Turning now to FIG. 1, the numeral 10 designates generally the high pulse repetition rate (PRF) spark gap switch of the present invention. In this embodiment, the spark gap switch is shown in its least complex form while encompassing all novel elements. Therein an insulating housing 12, essentially shaped as a hollow cylinder is provided with a cylindrical shaped cavity 14. Housing 12 has upper and lower openings to allow entry of metal electrodes. The high voltage electrode 16 has a substantially flat surface 18 which mates with and connects to a load such as a directed energy weapon. A lower electrode 20 is essentially a disk of conducting metal, in the embodiment of FIG. 1, approximately the same diameter as the insulating housing 12, with a smaller diameter cylindrical ring integral with the disk portion operatively sized to extend into cavity 14 through the lower aperture of insulating housing 12. Lower electrode 20 is machined and operatively spaced within housing 12 so as to form a spark gap between the ringlike top surface of the smaller hollow cylindrical portion of lower electrode 20 and upper electrode 16 at the approximate center of cavity 14.

An entry hole is machined through the center of the lower electrode 20 which provides entry into cavity 14. A trigger pin 24 extends through this hole and resides in the approximate center of the lower electrode 20. The pin is operatively spaced to reside within the center of the cylindrical portion of electrode 20 and extends into cavity 14 in cooperation with the ringlike top surface of the lower electrode. A high pressure insulating seal 22 holds trigger pin 24 positioned in the center of lower electrode 20 and insulates trigger pin 24 and lower electrode 20 electrically. Seal 22 is constructed with adequate strength and integrity to contain pressured hydrogen within cavity 14 at pressures exceeding 1000 p.s.i. Likewise, electrodes 16 and 20 must seal with housing 12 to contain the high pressure hydrogen within cavity 14.

In operation, the top electrode 16 is charged to high voltage and the bottom electrode 20 is grounded. At the desired time a low energy trigger pulse of short duration is applied to the trigger pin 24. The trigger pulse is usually of opposite polarity to the charged electrode 16. When the trigger pulse is applied a low energy spark forms between the trigger pin 24 and the lower electrode 20 which initiates the main spark. The main spark allows the energy stored in a pulse forming line (not shown) to be discharged through the switch to a load.

It is important to note that cavity 14 is charged with pure hydrogen gas to around 1000 psi to increase the self-breakdown voltage of the switch.

FIG. 1 represents the most elementary embodiment of the invention. FIG. 2 represents an embodiment actually constructed and used to test the actual operation of the high repetition rate spark gap switch.

Turning now to FIG. 2, the numeral 10 again designates an embodiment of the invention actually constructed and tested. This embodiment used a two-part stainless steel housing 11 and 13 to contain the high pressure hydrogen gas. Lower housing cap 13 is attached with a series of bolts 23 to upper housing 12. Sealing o-rings (not shown) helped seal the two housing parts against leakage.

The electrodes 16 and 20 and the trigger pin 24 are made of Elkonite®, a copper tungsten mixture known in the art for good erosion and thermal conductivity properties. Disks of Elkonite® were purchased from CMW, Inc. P.O. Box 2266, Indianapolis, Indiana 46206. Material designation was 10W3, RWMA group B, class 11 representing 25 percent copper and 75 percent tungsten. Electrical conductivity of 10W3 Elkonite® is 46 percent IACS with a rockwell hardness of 98 B and a density of GMS/CC 14.70. Copper tungsten materials of equivalent properties are widely available from other commercial sources.

Continuing with FIG. 2, a spacer ring 15 is also constructed of Elkonite® and is used to adjust the spark gap spacing.

The trigger pin 24 is insulated from stainless steel housing 13 with an insulator 17. Likewise, the upper electrode 16 is insulated with insulator 19. Both insulators 17 and 19 were constructed from Macor®. Macor® is a machinable isotropic glass ceramic having a density of 2.52 gm/cc and 0 percent porosity. The koop hardness of the material is NA 250 with a coefficient of thermal expansion of $94\times10^{-7}$ in/in° C. Macor® has a dielectric strength (A.C.) of 1,000 volts-mil and a volume resistivity greater than $10^{14}$ ohm-cm. Macor® is available from Accuratus Corp., R.D. 4, Brass Castle Road, Washington, New Jersey 07882. Insulators of equivalent properties are widely available from other commercial sources.

The spark gap switch tested by applicants and represented by FIG. 2 used Elkonite® for the electrodes and Macor® for the insulators, but it should be understood that other materials could be used depending on size and lifetime requirements. A quartz window 30 was included in the embodiment of FIG. 2 to allow researchers to view the spark. Voltage probe 32 encircles insulator 19 which acts as a dielectric and allows probe 32 to act as a capacitor voltage probe. A high pressure gas inlet valve 34 was provided to allow charging the switch cavity 14 with 1000 psi hydrogen gas. A plastic end cap 21 is attached to the lower housing 13 with a series of bolts 25. Plastic cap 21 holds trigger pin 24 and accompanying insulating seal 17 sealably within the housing and allows adjustment of the trigger pin.

In operation, the test spark gap switch of FIG. 2 works the same as the operation of the spark gap switch of FIG. 1 described above. The lower electrode 20 is held to ground potential along with housing sections 11 and 13. The upper electrode 16 is charged to high voltage, 50 kilovolts or greater, and trigger pin 24 provides a short, relatively low energy trigger pulse which causes a spark to form between trigger pin 24 and lower electrode 16. This spark initiates the main firing of switch 10.

Some time later, depending on the desired repetition rate, the pulse forming line (not shown) and the electrodes are again charged. If the spark gap has "recovered", a spark will not reform unless the switch is again triggered. The switch tested by applicants and represented by FIG. 2 exhibited recovery times of 100 microseconds, which corresponds to repetition rates of 10 KHz, without reaching a limit.

The test facility connected upper electrode 16 to a liquid resistive dummy load (not shown) with a stainless steel connecting rod 27. Trigger pin 24 was likewise connected to a trigger pulse forming network.

Turning now to FIG. 3, the advantages realized by charging the switch with hydrogen gas may be graphically appreciated. The hydrogen facilitates heat dissipation from the spark channel due to the higher molecular speed and higher thermal conductivity. As can be seen in FIG. 3, hydrogen is approximately an order of magnitude faster in recovery time as compared to air. FIG. 3 shows the percent recovery versus time, where recovery is defined as the amount of voltage that can be placed across the electrodes without intitiating another spark. Hydrogen is a light gas which also allows the spark channel to expand faster and thus reduces the amount of heat deposited in the switch.

Changes may be made in the construction and arrangement of parts or elements of the embodiments as disclosed herein without departing from the spirit and scope of the invention as defined in the following claims. For instance, the switch housing can be constructed from any material that can hold high-pressure hydrogen gas. The electrodes 16 and 20 can be constructed from any conducting material that can handle the peak currents without impractical erosion or heating, and can be any physical shape and size depending on system requirements. The insulators can be made of any insulating material that will handle the pressures and temperatures of the spark gap switch. The window 30, voltage probe 32 and spacer ring 15 are not necessary for the operation of the switch. The trigger pin insulating seal can be made of any insulating material capable of withstanding the pressure. The conducting rod 27 is made to interface with whatever device the switch will control and can be any shape of any conducting material as design constraints dictate. The trigger pin 24 can be made of any conducting material that does not erode excessively.

Applicants have built and tested a free running, high repetition rate spark gap switch without a trigger, and others in the art have employed lasers to trigger initiation of spark gap switches. It is believed that a laser trigger firing through a quartz window would allow the switch to be further undervolted.

What is claimed is:

1. A high pulse repetition rate spark gap switch comprising:

means for forming a high-pressure chamber;

first and second primary electrodes having opposed electrode surfaces and defining a primary arc gap within said chamber;

a high pressure hydrogen gas in said chamber;

a trigger pin defining a trigger gap between itself and said first primary electrode capable of receiving a trigger pulse.

2. A device according to claim 1 wherein said means for forming a high-pressure chamber comprises a stainless steel housing.

3. A device according to claim 2 wherein said stainless steel housing comprises a first and second section joined to form said means for forming a high-pressure chamber.

4. A device according to claim 1 wherein said means for forming a high-pressure chamber comprises an insulating housing.

5. A device according to claim 4 wherein said insulating housing comprises an isotropic glass ceramic.

6. A high pulse repetition rate spark gap switch according to claim 1 wherein said first and second primary electrodes comprises a copper tungsten conductor.

7. A device according to claim 2 wherein said first and second electrodes comprises an alloy of copper and tungsten.

8. A high pulse repetition rate spark gap switch according to claim 3 wherein said first and second electrodes comprises a conductor of copper and tungsten alloy.

9. A device according to claim 4 wherein said first and second electrodes comprises an alloy of copper and tungsten.

10. A device according to claim 5 wherein said first and second electrodes comprises an alloy of copper and tungsten.

11. A high-pulse repetition rate spark gap switch according to claim 1 wherein said trigger pin comprises a conductor of copper and tungsten.

12. A device according to claim 6 wherein said trigger pin is a conductor comprising copper and tungsten.

13. A high pulse repetition rate spark gap switch according to claim 1 further defined by:

a quartz observation window for viewing said high pressure chamber; and means for probing the voltage across the switch during operation whereby the operating parameters may be measured.

14. A high pulse repetition rate spark gap switch according to claim 6 further defined by:

a quartz viewing window accessing said means for forming a high-pressure chamber; and a high voltage probe to measure the operating voltage across the switch.

15. A device according to claim 13 wherein said voltage probe is a capacitance ring encircling said second electrode in a manner so as to form a capacitive divider.

16. A high-pulse repetition rate spark gap switch according to claim 1 wherein said first electrode is operated at ground potential; and said second electrode is operated at high voltage; and said trigger pin is operated at a potential opposite in polarity and lower in current compared to the current on said second electrode during switch operation.

17. A method of forming a high voltage, high-repetition rate spark gap switch comprising:

forming a high-pressure chamber;

filling said chamber with high-pressure hydrogen;

providing said chamber with a first and second electrode forming a spark gap;

extending a trigger pin within said chamber whereby a trigger pulse will form an arc between said trigger pin and said first electrode; and charging said second electrode with high voltage whereby a relatively low energy trigger pulse on said trigger pin will arc to said first electrode, thus initiating the main arc between said first and second electrodes.

18. A method according to claim 17 wherein said high pressure hydrogen is approximately 1000 psi.

19. A method according to claim 17 wherein said trigger pulse initiates switch firing at an undervolted potential not exceeding one half of the self-breakdown voltage of the device.

20. A method according to claim 19 wherein said undervolting provides initiation 35 percent of the self-breakdown voltage.

* * * * *